US011078609B2

(12) United States Patent
Muroya et al.

(10) Patent No.: US 11,078,609 B2
(45) Date of Patent: Aug. 3, 2021

(54) WEFT WITHDRAWING DEVICE OF AIR JET LOOM

(71) Applicant: KABUSHIKI KAISHA TOYOTA JIDOSHOKKI, Kariya (JP)

(72) Inventors: Haruki Muroya, Aichi-ken (JP); Ryuji Arai, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 28 days.

(21) Appl. No.: 16/739,955

(22) Filed: Jan. 10, 2020

(65) Prior Publication Data

US 2020/0224342 A1 Jul. 16, 2020

(30) Foreign Application Priority Data

Jan. 14, 2019 (JP) ..... JP2019-003965

(51) Int. Cl.

| | |
|---|---|
| ***D03D 51/08*** | (2006.01) |
| ***D03D 47/30*** | (2006.01) |
| ***D03D 51/34*** | (2006.01) |
| *D03D 45/50* | (2006.01) |

(52) U.S. Cl.

CPC ..... *D03D 51/085* (2013.01); *D03D 47/30* (2013.01); *D03D 51/34* (2013.01); *D03D 2700/26* (2013.01)

(58) Field of Classification Search

CPC ..... D03D 51/085; D03D 47/30; D03D 51/34; D03D 2700/26; D03D 47/3086; D03D 47/3073; D03D 47/36; D03D 47/3013; D03D 47/302; D03D 47/3066; D03D 49/00; D03J 1/002; D03J 1/04

See application file for complete search history.

(56) References Cited

U.S. PATENT DOCUMENTS

| | | | | |
|---|---|---|---|---|
| 3,805,850 A * | 4/1974 | Van Duynhoven | .... | D03D 47/00 139/1 E |
| 4,244,402 A * | 1/1981 | Hasegawa | ..... | D03D 47/278 139/435.1 |
| 4,347,872 A * | 9/1982 | Brouwer | ..... | D03D 5/00 139/435.1 |
| 4,458,732 A * | 7/1984 | Yoshida | ..... | D03D 47/278 139/435.5 |

(Continued)

FOREIGN PATENT DOCUMENTS

| | | |
|---|---|---|
| CN | 1031732 A | 3/1989 |
| JP | 64-085351 A | 3/1989 |
| JP | 2001-011753 A | 1/2001 |

*Primary Examiner* — Robert H Muromoto, Jr.

(74) *Attorney, Agent, or Firm* — Sughrue Mion, PLLC

(57) ABSTRACT

A weft withdrawing device of an air jet loom includes a blow nozzle blowing a weft that is ejected from a weft insertion main nozzle and determined to be a weft insertion failure to guide the weft to a weft withdrawing passage, a weft introducing duct that is integrally swingable with a sley forward and backward, a weft withdrawing mechanism withdrawing the weft guided to the weft introducing duct, and a weft sensor optically detecting the weft. The weft withdrawing device of the air jet loom includes a weft guide member. The weft guide member includes a cloth fell side top portion and a let-off side top portion. The cloth fell side top portion is located above the weft withdrawing passage.

3 Claims, 7 Drawing Sheets

(56) References Cited

U.S. PATENT DOCUMENTS 4,476,903 A * 10/1984 Gunneman ..... D03D 47/3013 139/435.4
4,520,849 A * 6/1985 Suzuki ..... D03D 51/085 139/116.1
4,559,976 A * 12/1985 Araki ..... D03D 47/3086 139/116.2
4,664,157 A * 5/1987 Shin ..... D03D 51/085 139/116.2
4,729,411 A * 3/1988 Ellenberger ..... D03D 47/30 139/116.2
4,744,393 A * 5/1988 Takegawa ..... D03D 47/3033 139/116.2
4,890,650 A * 1/1990 Mitsuya ..... D03D 51/085 139/116.2
4,898,214 A * 2/1990 Lewyllie ..... D03D 47/3013 139/116.2
4,958,662 A * 9/1990 Takegawa ..... D03D 51/085 139/116.2
4,989,644 A * 2/1991 Tanaka ..... D03D 47/34 139/116.2
5,005,609 A * 4/1991 Volland ..... D03D 47/3086 139/116.2
5,016,676 A * 5/1991 Fourneaux ..... D03D 51/34 139/116.2
5,090,454 A * 2/1992 Pierson ..... D03D 51/085 139/116.2
5,129,430 A * 7/1992 Mitsuya ..... D03D 51/085 139/116.2
5,158,120 A * 10/1992 Kaufmann ..... D03D 51/085 139/116.2
5,303,745 A * 4/1994 Kaufmann ..... D03D 51/085 139/116.2
5,590,692 A * 1/1997 Dornier ..... D03D 47/30 139/1 R
6,129,123 A * 10/2000 Ludwig ..... D03D 51/085 139/116.2
6,536,482 B1 * 3/2003 Peeters ..... D03D 47/302 139/435.5
6,953,066 B2 * 10/2005 Yoneda ..... D03D 47/3086 139/116.1
2003/0221738 A1 * 12/2003 Yoneda ..... D03D 47/34 139/116.2

* cited by examiner

WEFT WITHDRAWING DEVICE OF AIR JET LOOM

CROSS REFERENCE TO RELATED APPLICATION

This application claims priority to Japanese Patent Application No. 2019-003965 filed on Jan. 14, 2019, the entire disclosure of which is incorporated herein by reference.

BACKGROUND ART

The present disclosure relates to a weft withdrawing device of an air jet loom.

There has been known a device for withdrawing a failure weft of an air jet loom disclosed in Japanese Patent Application Publication No. S64-85351 as a conventional technique of a weft withdrawing device of an air jet loom. This type of the weft withdrawing device guides a weft that has failed in weft insertion to a weft introducing duct disposed adjacently to a weft insertion passage, withdraws the weft guided to the weft introducing duct by press-contact between a pair of rollers, and brings the withdrawn weft into contact with a turning detection arm to detect the weft.

In addition, there has been known a device for removing a failure weft of a fluid jet loom disclosed in Japanese Patent Application Publication No. 2001-11753 as another conventional technique. This type of the weft removing device includes a yarn winder that captures and takes up a failure yarn and a detector for detecting the failure yarn. When a weft insertion failure occurs, a weft from a main nozzle for weft insertion is kept continuous with the failure yarn by avoiding a cut of the failure yarn with a yarn feeding cutter, that is, the weft is uncut, and then, the yarn winder is moved to a capture position near the main nozzle to capture the failure yarn. After that, the yarn winder is moved to a take-up position. The failure yarn is cut off from the weft from the main nozzle and withdrawn from a cloth by the yarn winder. The detector for detecting the failure yarn is attached to an arm portion of a moving bracket. A casing of the detector includes a pair of guide walls that extends toward each end of the guide walls and a detection wall located in a convergence direction of the pair of guide walls. The detector has a detection area in the vicinity of the detection wall. The pair of guide walls is formed so that the guide walls open in a moving direction of the guide walls when the yarn winder is moved to the take-up position.

However, fiber dust is easily attached to the turning detection arm of the weft withdrawing device disclosed in the Publication No. S64-85351, requiring a removing work to remove the attached fiber dust frequently. To solve this, it is considered that the weft detector in the Publication No. 2001-11753 is applied to the weft withdrawing device in the Publication No. S64-85351. In the weft withdrawing device in the Publication No. S64-85351, the weft introduced to the weft introducing duct moves to a rear weft withdrawing position from the front with the weft introducing duct in accordance with swing of a reed. Accordingly, a moving path of the weft introduced to the weft introducing duct in accordance with the swing of the reed is determined by movement of the weft introducing duct. On the other hand, the weft detector of the Publication No. 2001-11753 includes the pair of guide walls that extends toward each end of the guide walls and the detection wall located in the convergence direction of the pair of guide walls. The weft detector has the detection area in the vicinity of the detection wall. Therefore, in a case where the weft detector having the pair of guide walls in the Publication No. 2001-11753 is simply applied so as to guide a weft to the detection region of the weft detector in the Publication No. 2001-11753, there is a problem that the weft detector interferes with the weft, preventing the movement of the weft to the weft withdrawing position.

The present disclosure has been made in view of the above circumstances and is directed to a weft withdrawing device of an air jet loom surely detecting a weft that has failed in weft insertion without preventing movement of the weft by a weft detector and removing fiber dust attached to the weft detector.

SUMMARY

In accordance with an aspect of the present disclosure, there is provided a weft withdrawing device of an air jet loom that includes a blow nozzle blowing a weft that is ejected from a weft insertion main nozzle and determined to be a weft insertion failure to guide the weft to a weft withdrawing passage adjacent to a weft insertion passage, a weft introducing duct that is integrally swingable with a sley forward and backward and to which the weft blown and guided to the weft withdrawing passage is introduced, a weft withdrawing mechanism provided on the weft withdrawing passage, and withdrawing the weft guided to the weft introducing duct by a pair of rollers, and a weft sensor optically detecting the weft that is withdrawn through the weft withdrawing passage. The weft withdrawing device of the air jet loom includes a weft guide member having a guide recess to which the weft is introduced and supporting the weft sensor at a position where the weft sensor detects the weft introduced to the guide recess. The weft guide member includes a cloth fell side top portion having a top portion near a cloth fell and forming the guide recess and a let-off side top portion having a top portion near the warps to be let-off and forming the guide recess. The cloth fell side top portion is located above the weft withdrawing passage in a state before the pair of the rollers is brought into press-contact with the weft.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

First Embodiment

Figure 1:
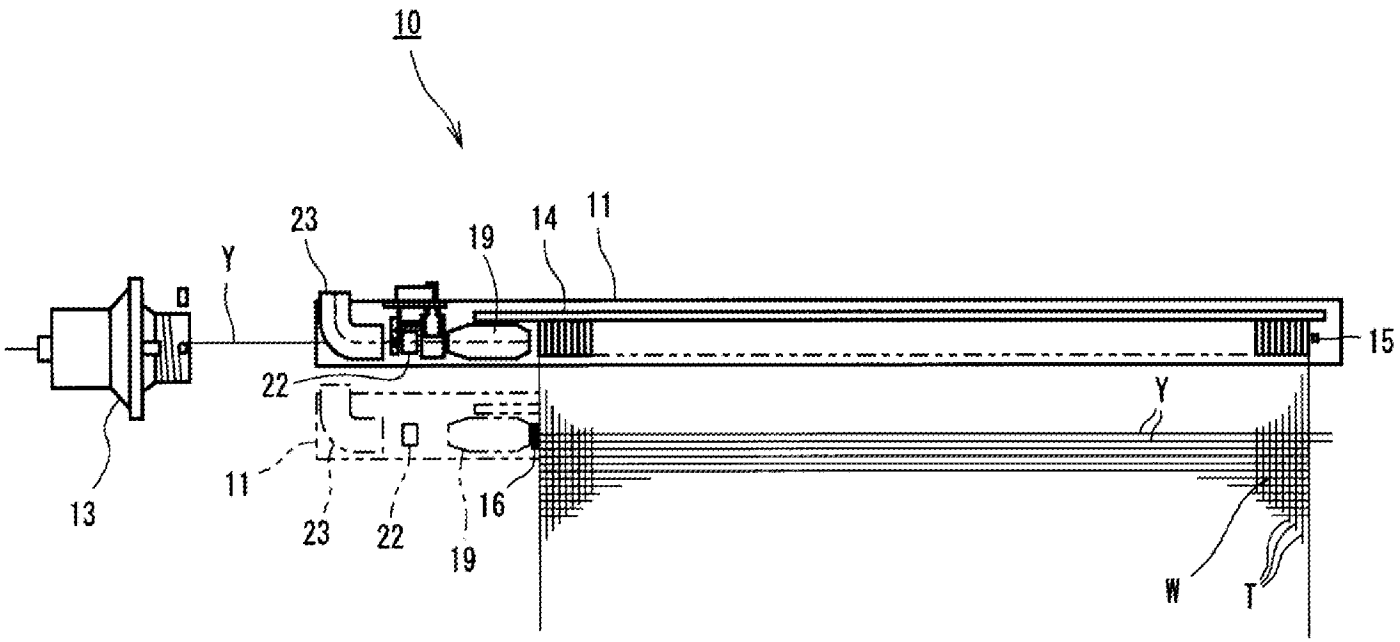
FIG. 1 is a plan view schematically showing a weft withdrawing device of an air jet loom according to a first embodiment of the present disclosure.
Figure 2:
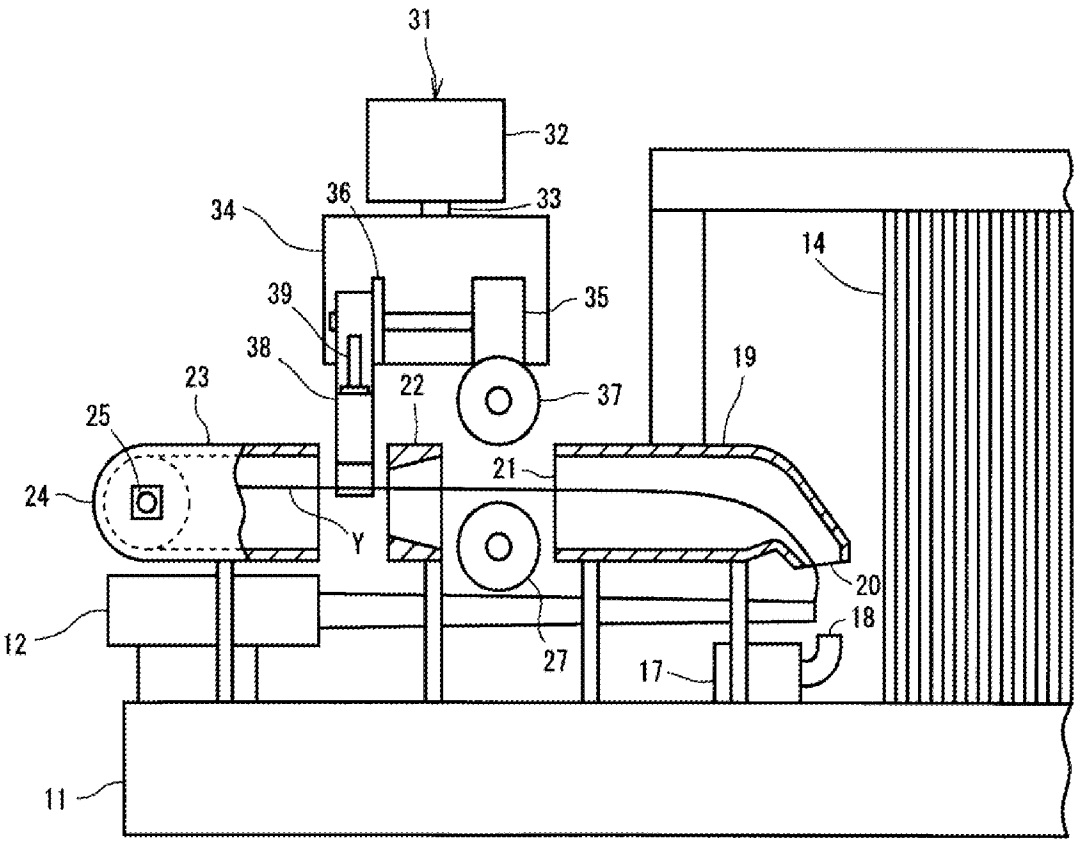
FIG. 2 is a front view showing a main section of the weft withdrawing device of the air jet loom according to the first embodiment.

The following will describe a weft withdrawing device of an air jet loom according to a first embodiment of the present disclosure with reference to the accompanying drawings. Referring to FIG. 1 and FIG. 2, an air jet loom 10 includes a sley 11 and a weft insertion main nozzle 12 attached to a first end side of the sley 11. The air jet loom 10 also includes a weft measuring and storing device 13 near the weft insertion main nozzle 12. The weft measuring and storing device 13 measures a length of a weft Y and stores the weft Y by winding the weft Y. The weft Y stored in the weft measuring and storing device 13 is supplied to the weft insertion main nozzle 12 in synchronization with timing of weft insertion.

A profiled reed 14 is provided upright on the sley 11 and has a weft insertion passage (not shown). The weft insertion passage of the profiled reed 14 is a passage through which the weft Y ejected from the weft insertion main nozzle 12 is propelled in synchronization with timing of weft insertion. The sley 11 includes a plurality of auxiliary nozzles for weft insertion (not shown). Compressed air is jetted from these auxiliary nozzles for weft insertion to help propel the weft Y ejected from the weft insertion main nozzle 12.

The weft insertion main nozzle 12 ejects the weft Y stored in the weft measuring and storing device 13 to the weft insertion passage of the profiled reed 14 in synchronization with the timing of weft insertion. A weft feeler 15 is disposed in a second end side of the sley 11. The weft feeler 15 detects whether or not a weft insertion failure occurs. When the weft insertion is normally performed, an end of the weft Y passes through a shed formed by warps T and arrives at a position at which the weft feeler 15 is disposed. The weft feeler 15 is connected to a control device (not shown) that determines a weft insertion failure when the weft feeler 15 detects the weft insertion failure. The profiled reed 14 performs beating up motion when the weft insertion has been normally performed.

A weft cutter 16 cutting the weft Y is provided near an end of a woven cloth W which is close to the weft insertion main nozzle 12. The weft cutter 16 cuts the weft Y every beating up by the profiled reed 14 when weft insertion is normally performed, separating the weft Y away from the weft insertion main nozzle 12. On the other hand, when a weft insertion failure has occurred, the weft cutter 16 does not cut the weft Y, not separating the weft Y away from the weft insertion main nozzle 12.

Referring to FIG. 2, a blow nozzle 17 is disposed on the sley 11 in such a manner that the blow nozzle 17 is located directly below the weft insertion main nozzle 12. The blow nozzle 17 blows the weft Y that is ejected from the weft insertion main nozzle 12 and determined to be a weft insertion failure to guide the weft Y to a weft withdrawing passage adjacent to the weft insertion passage. Compressed air is jetted from a nozzle hole 18 of the blow nozzle 17 in a direction in which the compressed airflow intersects with a direction of weft insertion at a front side of the weft insertion main nozzle 12. The weft insertion passage herein refers to the passage through which the weft Y is propelled.

A weft introducing duct 19 is disposed above the blow nozzle 17. The weft introducing duct 19 is a duct to which the weft Y blown and guided to the weft withdrawing passage adjacent to the weft insertion passage by the blow nozzle 17 is introduced. An inlet 20 of the weft introducing duct 19 faces the nozzle hole 18 of the blow nozzle 17. An air guide 22 is disposed so as to face an outlet 21 of the weft introducing duct 19. Furthermore, a suction duct 23 is disposed so as to face an outlet of the air guide 22. The air guide 22 helps the weft Y introduced to the weft introducing duct 19 to be guided to the suction duct 23. A blade body cutting the weft Y that has failed in weft insertion (hereinafter, called failure weft Y) (not shown) is disposed between the inlet 20 of the weft introducing duct 19 and a nozzle end of the weft insertion main nozzle 12.

Figure 3:
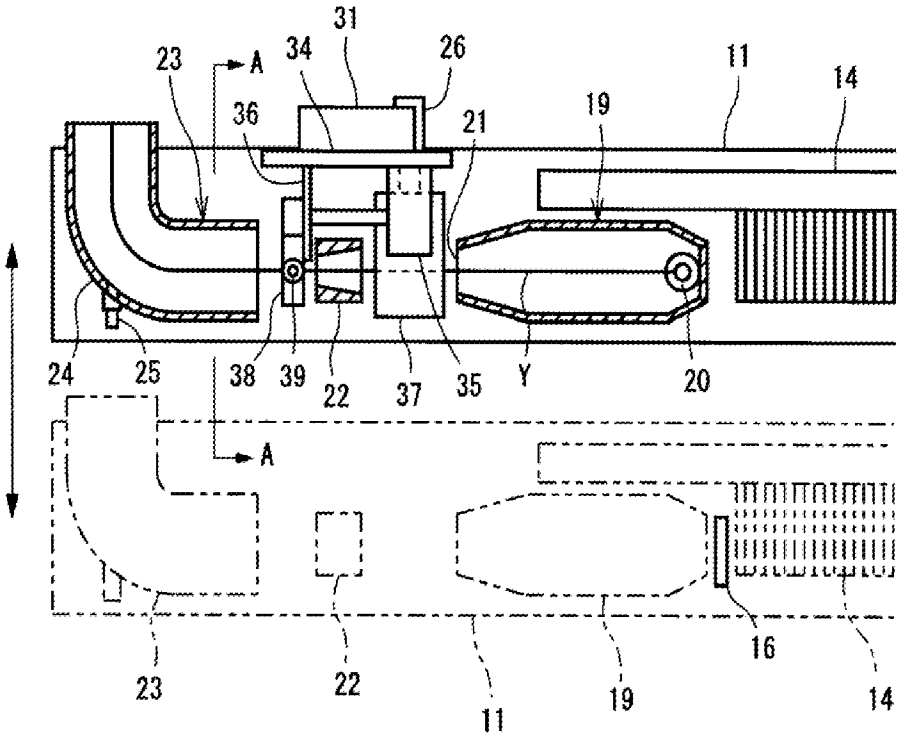
FIG. 3 is a plan view showing the main section of the weft withdrawing device of the air jet loom according to the first embodiment.

Referring to FIG. 3, the suction duct 23 is curved so that an outlet of the suction duct 23 is oriented to a dust box (not shown). The dust box is disposed at a rear side of a sley swinging area where the sley 11 is swingable. In this embodiment, a front side is defined as a side where there is a cloth fell and a rear side is defined as a side from which the warps T are let off. An air nozzle 25 that is connected to the air supply source is connected to a curved portion 24 of the suction duct 23. The air nozzle 25 faces the outlet of the suction duct 23. The weft introducing duct 19, the air guide 22, and the suction duct 23 cooperate to form the weft withdrawing passage through which the weft Y is withdrawn and the weft withdrawing passage is integrally swingable with the sley 11 forward and backward.

Figure 4:
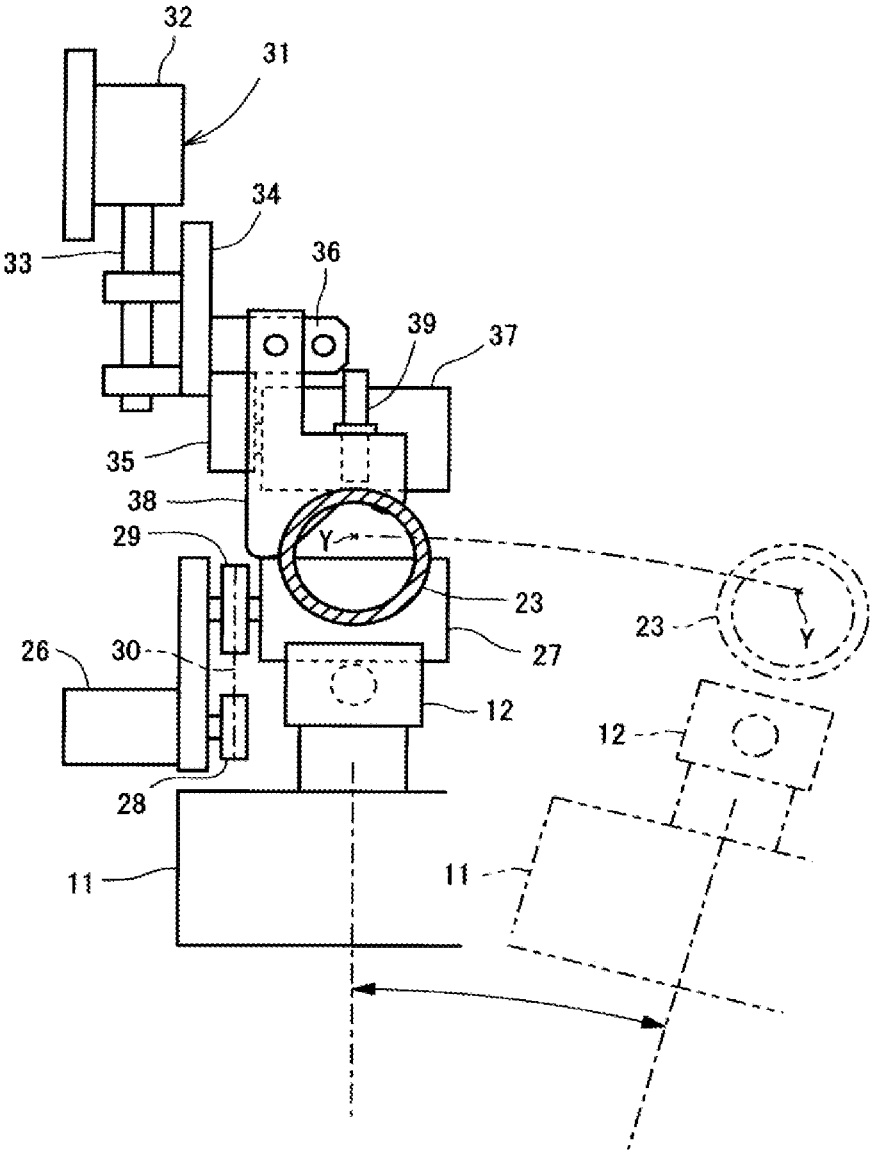
FIG. 4 is a view as viewed in the direction of arrows A, A of FIG. 3.

Referring to FIG. 4, a stepping motor 26 is disposed in a machine at the rear side of the sley swinging area. A drive roller 27 is rotatably supported above the stepping motor 26. A drive pulley 28 of the stepping motor 26 and a driven pulley 29 near the drive roller 27 are connected by a timing belt 30. An air cylinder 31 is disposed above the stepping motor 26 in a higher position than a position of the drive roller 27. The air cylinder 31 includes an air cylinder body 32 attached so as to be oriented to the machine and a rod 33 extending to or retracting from the air cylinder body 32. A direction in which the rod 33 extends to or retracts from is an upper and lower direction.

The rod 33 of the air cylinder 31 is attached to a rear surface of a plate member 34 that is positioned upright. With this configuration, the plate member 34 is raised and lowered by an operation of the air cylinder 31. The plate member 34 includes on a front surface thereof a first bracket 35 and a second bracket 36 protruding toward a front side of the air jet loom 10.

A driven roller 37 is rotatably supported by the first bracket 35. The driven roller 37 faces the drive roller 27 that is located below the driven roller 37. Lowering the rod 33 of the air cylinder 31 brings the driven roller 37 into contact with the drive roller 27, pressing the drive roller 27. When the sley 11 moves to the rear side of the machine in the sley swinging area, the drive roller 27 and the driven roller 37 are located between the weft introducing duct 19 and the air guide 22 on the weft withdrawing passage. The drive roller 27 and the driven roller 37 correspond to a pair of rollers provided in the weft withdrawing mechanism in the present disclosure. Accordingly, the weft withdrawing mechanism in the first embodiment has the stepping motor 26, the drive roller 27, and the driven roller 37, and is provided on the weft withdrawing passage. The weft withdrawing mechanism withdraws the weft Y guided to the weft introducing duct 19 by the drive roller 27 and the driven roller 37. The stepping motor 26 is controlled on the basis of an order of the control device.

A weft guide member 38 is attached to the second bracket 36. Thus, the weft guide member 38 is movable to the weft Y when the weft Y is withdrawn by the drive roller 27 and the driven roller 37. The weft guide member 38 supports a weft sensor 39 optically detecting the weft Y that is withdrawn through the weft withdrawing passage. The weft guide member 38 guides the weft Y through the weft withdrawing passage to a detectable range of the weft sensor 39. The weft sensor 39 is a reflective optical sensor, and has a light projecting portion (not shown) that emits sensor light to the weft Y and a light receiving portion (not shown) that receives reflected light from the weft Y. The weft sensor 39 is electrically connected to the control device. When the weft sensor 39 detects the weft Y, the weft sensor 39 sends a detection signal to the control device.

Figure 5A:
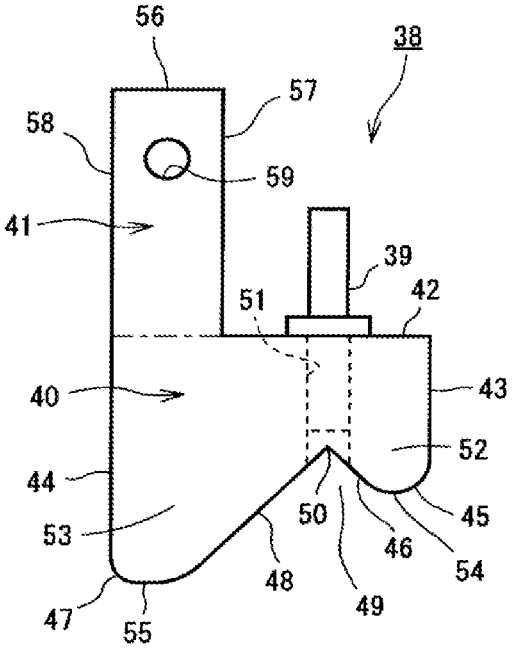
FIG. 5A is a side view of a weft guide member of FIG. 4.
Figure 5B:
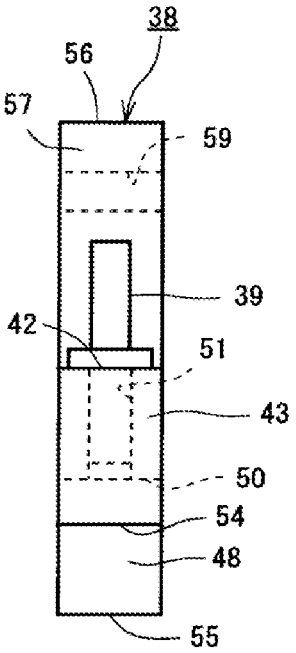
FIG. 5B is a rear view of the weft guide member of FIG. 4.
Figure 5C:
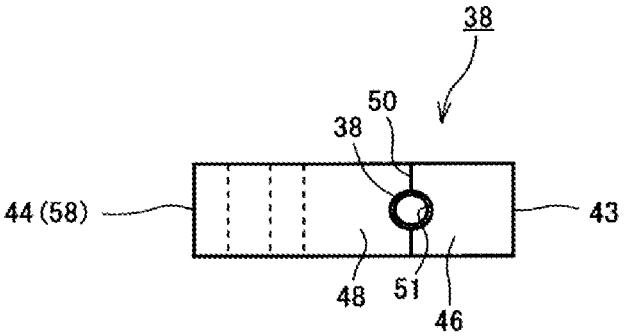
FIG. 5C is a bottom view of the weft guide member of FIG. 4.

The following will describe a shape of the weft guide member 38, especially each portion of the weft guide member 38 using the upper and lower direction and the front and rear direction of the weft guide member 38 attached to the second bracket 36 as a reference. Referring to FIG. 5A, the weft guide member 38 has a guide body portion 40 and an arm portion 41 integrally formed with the guide body portion 40.

The guide body portion 40 includes an upper end face 42, a first side face 43, a second side face 44, a first arcuate face 45, a first sloped face 46, a second arcuate face 47, and a second sloped face 48. The upper end face 42 is oriented upward and the arm portion 41 is located at a rear side of the upper end face 42. The first side face 43 extends downward from a front end of the upper end face 42, and faces forward. The second side face 44 faces rearward at the opposite side of the weft guide member 38 relative to the first side face 43.

The first arcuate face 45 extends continuously from a lower end of the first side face 43, and the first sloped face 46 extends continuously from the first arcuate face 45. The first sloped face 46 is a sloped face extending rearward and upward as the first sloped face 46 is distanced far from the first arcuate face 45. The second arcuate face 47 continuously extends from a lower end of the second side face 44, and the second sloped face 48 continuously extends from the second arcuate face 47. The second sloped face 48 is a sloped face extending forward and upward as the second sloped face 48 is distanced far from the second arcuate face 47. Upper ends of the first sloped face 46 and the second sloped face 48 are connected with each other. Thus, the guide body portion 40 has a guide recess 49 formed by the first arcuate face 45, the first sloped face 46, and the second sloped face 48. A deepest portion 50 of the guide recess 49 has a through hole 51 passing from the guide recess 49 to the upper end face 42. The weft sensor 39 is inserted through the through hole 51. The weft guide member 38 has the guide recess 49 to which the weft Y is introduced and supports the weft sensor 39 at a position where the weft sensor 39 detects the weft Y introduced to the guide recess 49.

The first side face 43, the first arcuate face 45, and the first sloped face 46 cooperate to form a cloth fell side protruding portion 52 protruding downward in the guide body portion 40 near the cloth fell. The second side face 44, the second arcuate face 47, and the second sloped face 48 cooperate to form a let-off side protruding portion 53 protruding downward in the guide body portion 40 near the warps T to be let off. Thus, the cloth fell side protruding portion 52 and the let-off side protruding portion 53 are located in the front side and the rear side of the guide recess 49, respectively.

Figure 6A:
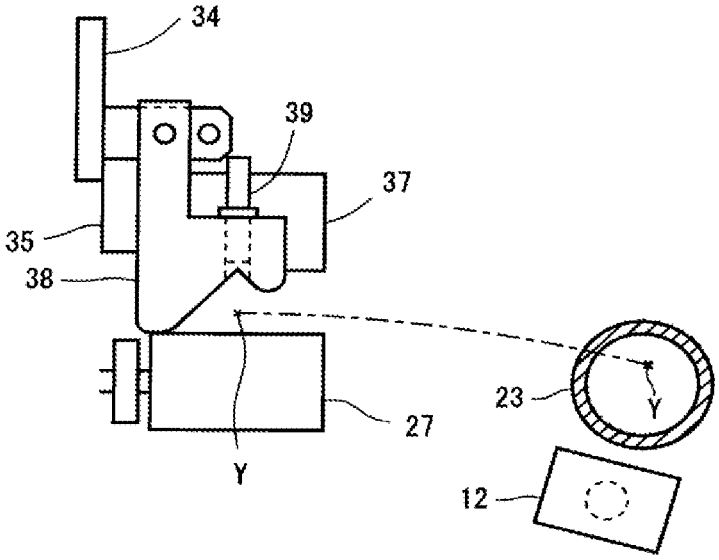
FIG. 6A is a side view showing the main section of the weft withdrawing device of the air jet loom of FIG. 1 in a state before the weft guide member is lowered.
Figure 6B:
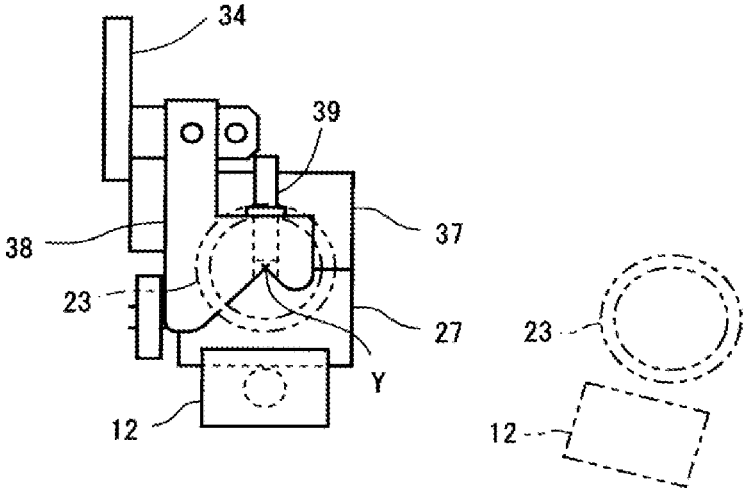
FIG. 6B is a side view showing the main section of the weft withdrawing device of the air jet loom of FIG. 1 in a state after the weft guide member has been lowered.

The cloth fell side protruding portion 52 of the weft guide member 38 includes a cloth fell side top portion 54 having a top portion near the cloth fell and forming the guide recess 49. The cloth fell side top portion 54 is located at the bottom of the cloth fell side protruding portion 52. Referring to FIG. 6A, the cloth fell side top portion 54 is located above the weft withdrawing passage in a state before the drive roller 27 and the driven roller 37 are brought into press-contact with the weft Y With this configuration, even if the weft Y introduced to the suction duct 23 from the weft introducing duct 19 moves from the cloth fell toward the warps T to be let off, by the swing of the sley 11, the weft Y is not interfered with the weft guide member 38. Referring to FIG. 6B, the cloth fell side top portion 54 is located below the weft withdrawing passage in a state that the drive roller 27 and the driven roller 37 are brought into press-contact with the weft Y.

The let-off side protruding portion 53 of the weft guide member 38 includes a let-off side top portion 55 having a top portion near the warps T to be let-off and forming the guide recess 49. The let-off side top portion 55 is located at the bottom of the let-off side protruding portion 53. The let-off side top portion 55 is located at a lower position than a position of the cloth fell side top portion 54. Thus, the let-off side top portion 55 is located below the weft withdrawing passage. This means that a distance from the deepest portion 50 of the guide recess 49 to the cloth fell side top portion 54 in the upper and lower direction is shorter than a distance from the deepest portion 50 of the guide recess 49 to the let-off side top portion 55 in the upper and lower direction. The let-off side top portion 55 is located below the weft withdrawing passage. This configuration helps the weft Y to be guided by the second sloped face 48, so that the weft Y may easily approach the weft sensor 39.

The arm portion 41 of the weft guide member 38 extends upward in a rear portion of the guide body portion 40. The arm portion 41 includes an upper end face 56, a front face 57, and a rear face 58. The front face 57 is connected to a front end of the upper end face 56 and a rear end of the upper end face 42 of the guide body portion 40. The rear face 58 has the same surface as the second side face 44 of the guide body portion 40. The arm portion 41 has a communicating hole 59 through which a bolt is inserted near an upper end of the arm portion 41. The weft guide member 38 is fixed to the second bracket 36 by the bolt (not shown) inserted through the communicating hole 59.

The following will describe an operation of the weft withdrawing device of the air jet loom 10 according to the first embodiment. In an operation state of the air jet loom 10, weft insertion of the weft Y ejected from the weft insertion main nozzle 12 is normally performed, and the weft Y arrives at an end of the cloth W located at the opposite side of the weft insertion main nozzle 12. The profiled reed 14 then beats up the weft Y, and the weft Y is woven in the cloth fell of the cloth W. The beaten up weft Y is cut off by the weft cutter 16 disposed near the weft insertion main nozzle 12. After that, the weaving operation is continued by repetition of weft insertion.

When a weft insertion failure in which the weft Y does not arrive at the end of the cloth W located at the opposite side of the weft insertion main nozzle 12 occurs, the weft feeler 15 detects the weft insertion failure. An operation of the drive motor of a main axis (not shown) is stopped on the basis of a detection signal indicating the weft insertion failure from the weft feeler 15. After the detection signal of the weft insertion failure is sent, the main axis rotates substantially once by inertia and stops. This means that the detection signal of the weft insertion failure is sent while the sley 11 proceeds toward the cloth W from the rearmost position in the sley swinging area. The failure weft Y is beaten up against the cloth W, and then, the sley 11 further repeats reciprocating motion and stops just before a reed beating position shown by two-dot chain lines in FIG. 1 and FIG. 3. The cutting motion of the weft cutter 16 is suspended in response to the weft insertion failure detection signal issued. The uncut weft Y of the weft insertion failure that has been woven in the cloth W remains extending from the weft insertion main nozzle 12.

Subsequently, compressed air is supplied to the blow nozzle 17 and the air nozzle 25. This generates airflow in a suction direction into an inlet of the suction duct 23 as well as airflow crossing the weft insertion passage between the blow nozzle 17 and the weft introducing duct 19. The airflow is generated while the sley 11 moves from a position shown by actual lines and stops at a position shown by the two-dot chain lines in FIG. 3 in the state in which the weft cutter 16 does not cut the weft Y. Thus, the weft Y of the weft insertion failure is woven in the state that the weft Y extends from the weft insertion main nozzle 12. The following weft Y of the weft Y of the weft insertion failure is withdrawn from the weft measuring and storing device 13 by the compressed air jetted from the blow nozzle 17 and forcibly introduced into the weft introducing duct 19.

When the following weft Y of the failure weft Y has a predetermined length or more, and is smoothly introduced into the weft introducing duct 19, the following weft Y passes from the outlet 21 through the air guide 22 and arrives at the suction duct 23. The following weft Y is then blown to the dust box by an jetting operation of the blow nozzle 17. Thus, appropriate tension is applied to the weft Y between the weft introducing duct 19 and the suction duct 23, so that the weft Y is taut.

The main axis rotates reversely by a predetermined rotation amount after the main axis stops. The sley 11 moves to the rearmost position, moving the weft Y to the weft withdrawing passage. Referring to FIG. 6A, the cloth fell side top portion 54 of the weft guide member 38 is located above the weft withdrawing passage, so that the weft Y is not interfered with the weft guide member 38 when the weft Y is moved to the weft withdrawing passage. The warps T form a shed by the reverse rotation of the main axis, releasing a state in which the failure weft Y has been woven.

At the same time when the states in which the weft Y of the weft insertion failure has been woven is released, the following weft Y between the weft introducing duct 19 and the air guide 22 is disposed between the drive roller 27 and the driven roller 37, and the following weft Y between the air guide 22 and the suction duct 23 is disposed below the weft guide member 38 including the weft sensor 39. Then, the rod 33 of the air cylinder 31 is lowered, lowering the plate member 34. Lowering the plate member 34 brings the driven roller 37 into press-contact with the drive roller 27, and the weft guide member 38 is lowered, as shown in FIG. 6B.

Lowering the weft guide member 38 brings the weft Y into press-contact with the drive roller 27 and the driven roller 37. In addition, lowering the weft guide member 38 moves the weft Y relative to the weft guide member 38, locating the weft Y in the guide recess 49. When the weft Y is located in the guide recess 49, the first sloped face 46 and the second sloped face 48 of the weft guide member 38 guide the weft Y to the deepest portion 50 of the guide recess 49 with the weft Y in sliding contact with the first sloped face 46 and the second sloped face 48 of the weft guide member 38 in accordance with a position of the weft Y. When the weft Y is located in the guide recess 49, the weft sensor 39 optically detects the weft Y. In a case where there is fiber dust in the first sloped face 46 and the second sloped face 48, the fiber dust is twined and caught by the guided weft Y.

When the weft Y is detected by the weft sensor 39, the stepping motor 26 is driven. While the drive roller 27 rotates by a predetermined rotation amount, the drive roller 27 and the driven roller 37 rotate in a state in which the weft Y is held by the drive roller 27 and the driven roller 37. The weft Y is withdrawn toward the suction duct 23 by the rotating of the drive roller 27 and the driven roller 37. When the weft Y is withdrawn, withdrawal tension is generated in the weft Y. The blade body cuts off the weft Y by the withdrawal tension, separating the weft Y away from the weft insertion main nozzle 12. Thus, when the end of the weft Y of a weft insertion failure passes between drive roller 27 and the driven roller 37, the weft sensor 39 does not detect the weft Y. Therefore, the weft Y of the weft insertion failure is discharged to the dust box. In a case where the weft Y twines and catches fiber dust attached to the weft guide member 38, the weft Y is discharged to the dust box with the fiber dust.

When the weft sensor 39 does not detect the weft Y, the supply of compressed air to the blow nozzle 17 and the air nozzle 25 is stopped, and the rod 33 of the air cylinder 31 is raised, raising the plate member 34. The driven roller 37 and the weft guide member 38 are raised and returns to an original position by raising the plate member 34, and then, the weaving is resumed.

The weft withdrawing device of the air jet loom 10 of the first embodiment provides the following advantageous effects.

(1) The weft Y determined to be a weft insertion failure is introduced to the weft introducing duct 19 by the blowing of the blow nozzle 17. The weft Y in the weft introducing duct 19 moves to the weft withdrawing passage with the weft introducing duct 19, and is withdrawn by the drive roller 27 and the driven roller 37. The weft sensor 39 optically detects the withdrawn weft Y. In the state before the drive roller 27 and the driven roller 37 are brought into press-contact with the weft Y, the cloth fell side top portion 54 of the weft guide member 38 is located above the weft withdrawing passage, so that the weft Y is not interfered with the weft guide member 38 when the weft Y is moved to the weft withdrawing passage. In addition, when the weft Y is withdrawn, the weft Y is guided to the guide recess 49, so that the weft Y is surely detected, and fiber dust that is located in the guide recess 49 is removed by the weft Y. Thus, the weft sensor 39 surely detects the failure weft Y without preventing the movement of the weft Y and fiber dust attached to the weft sensor 39 is removed.

(2) The weft guide member 38 is attached to the plate member 34 via the second bracket 36. The plate member 34 may be raised and lowered by an operation of the air cylinder 31. The weft guide member 38 moves to the weft Y when the weft Y is withdrawn by the drive roller 27 and the driven roller 37, easily introducing the weft Y to the guide recess 49, so that the weft Y may be surely detected.

(3) The weft guide member 38 has the let-off side top portion 55 having a top portion near the warps T to be let off. The distance from the deepest portion 50 of the guide recess 49 to the cloth fell side top portion 54 is shorter than the distance from the deepest portion 50 of the guide recess 49 to the let-off side top portion 55. With this configuration, the weft Y moves to the weft withdrawing passage without interfering with the cloth fell side top portion 54, and is easily introduced to the guide recess 49 by the let-off side top portion 55 of the weft guide member 38.

Second Embodiment

The following will describe a weft withdrawing device of the air jet loom 10 according to a second embodiment. The second embodiment is different from the first embodiment in that the weft guide member is not raised and lowered but fixed. In the second embodiment, the same configuration as that of the first embodiment is denoted by the same numerals with reference to the description of the first embodiment.

Figure 7:
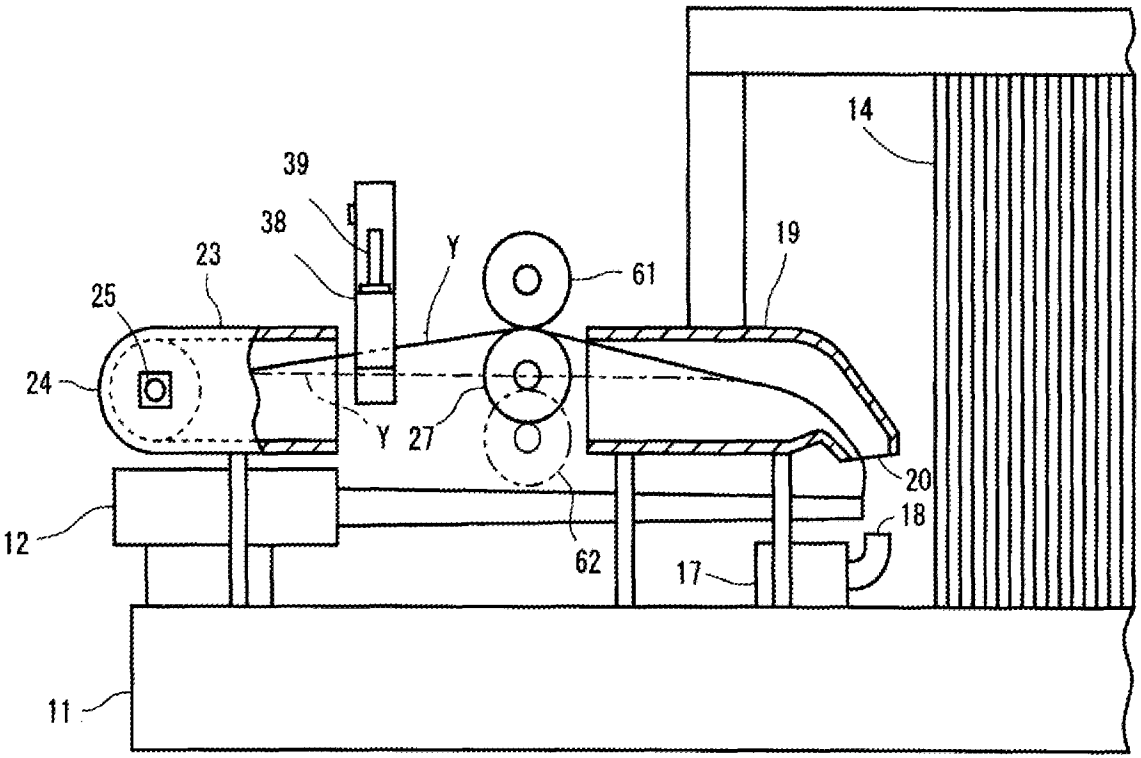
FIG. 7 is a front view showing a main section of a weft withdrawing device of an air jet loom according to a second embodiment of the present disclosure.

Referring to FIG. 7, the weft withdrawing device of the air jet loom 10 does not include the air guide 22 between the weft introducing duct 19 and the suction duct 23. The weft withdrawing mechanism has a drive roller 61 and a driven roller 62 corresponding to a pair of rollers in the present disclosure. The drive roller 61 is disposed above the driven roller 62 and attached to a fixing bracket (not shown). The drive roller 61 in the second embodiment is not raised and lowered. The driven roller 62 that is disposed below the drive roller 61 is raised and lowered so as to extend to and retract from the drive roller 61. The driven roller 62 is attached to a movable bracket (not shown) that is raised and lowered by an air cylinder (not shown). The weft guide member 38 is fixed to a fixing bracket so as not to be raised and lowered as well as the drive roller 61. The height of the weft guide member 38 is set so that the cloth fell side top portion 54 of the weft guide member 38 is located above the weft withdrawing passage.

The failure weft Y is introduced to the weft introducing duct 19 and the suction duct 23 by compressed air of the blow nozzle 17 and the air nozzle 25. In a state in which the driven roller 62 is not raised, the weft Y on the weft withdrawing passage is located below the drive roller 61 and the weft guide member 38. When the driven roller 62 is raised, the driven roller 62 brings up the weft Y into contact with the drive roller 61. The weft Y is brought into press-contact with the drive roller 61 and the driven roller 62, and has an inverted V shape by bringing up the driven roller 62. In the weft guide member 38, the weft Y is located in the guide recess 49 by bringing up the weft Y, and then, the weft sensor 39 detects the weft Y of the guide recess 49. When the weft Y is detected by the weft sensor 39, the drive roller 61 is driven, so that the weft Y of the weft insertion failure is discharged to the dust box.

The second embodiment provides the same advantageous effects as those in (1) and (3) of the first embodiment. In addition, the weft Y of a weft insertion failure on the weft withdrawing passage may be detected even if the weft guide member 38 is fixed.

The above embodiments each describe an exemplary embodiment of the present disclosure. The present disclosure is not limited to the specific embodiments described above, and may appropriately be modified within the gist of the disclosure as described below.

In the above embodiments, the distance from the deepest portion of the guide recess to the cloth fell top portion is shorter than the distance from the deepest portion of the guide recess to the let-off side top portion. However, the present disclosure is not limited to this embodiment. For example, the distance from the deepest portion of the guide recess to the cloth fell top portion may be the same as that from the deepest portion of the guide recess to the let-off side top portion.

In the above embodiments, one roller of the pair of rollers is fixed and the other roller is a movable roller that may extend to and retract from the one roller. However, the present disclosure is not limited to these embodiments. For example, the both rollers may be movable rollers that may extend to and retract from each other.

In the above embodiments, the weft guide member repeats reciprocating motion in an upper and lower direction in liner motion. However, the present disclosure is not limited to these embodiments. The weft withdrawing device of the air jet loom includes a configuration in which, for example, the weft guide member may repeat reciprocating motion in the upper and lower direction in circular motion.

What is claimed is:

1. A weft withdrawing device of an air jet loom comprising:

a blow nozzle blowing a weft that is ejected from a weft insertion main nozzle and determined to be a weft insertion failure to guide the weft to a weft withdrawing passage adjacent to a weft insertion passage;

a weft introducing duct that is integrally swingable with a sley forward and backward and to which the weft blown and guided to the weft withdrawing passage is introduced;

a weft withdrawing mechanism provided on the weft withdrawing passage, and withdrawing the weft guided to the weft introducing duct by a pair of rollers; and a weft sensor optically detecting the weft that is withdrawn through the weft withdrawing passage, wherein the weft withdrawing device of the air jet loom includes a weft guide member having a guide recess to which the weft is introduced and supporting the weft sensor at a position where the weft sensor detects the weft introduced to the guide recess, the weft guide member includes a cloth fell side top portion having a top portion near a cloth fell and forming the guide recess and a let-off side top portion having a top portion near the warps to be let-off and forming the guide recess, and the cloth fell side top portion is located above the weft withdrawing passage in a state before the pair of the rollers is brought into press-contact with the weft.

2. The weft withdrawing device of the air jet loom according to claim 1, wherein the weft guide member is movable to the weft when the weft is withdrawn by the pair of the rollers.

3. The weft withdrawing device of the air jet loom according to claim 1, wherein a distance from a deepest portion of the guide recess to the cloth fell side top portion is shorter than a distance from the deepest portion of the guide recess to the let-off side top portion.

* * * * *